US005547314A

United States Patent [19]

Ames

[11] Patent Number: 5,547,314

[45] Date of Patent: Aug. 20, 1996

[54] OFFSHORE SYSTEM AND METHOD FOR STORING AND TRIPPING A CONTINUOUS LENGTH OF JOINTED TUBULAR CONDUIT

[75] Inventor: Thomas J. Ames, Houston, Tex.

[73] Assignee: Marathon Oil Company, Findlay, Ohio

[21] Appl. No.: 488,476

[22] Filed: Jun. 8, 1995

[51] Int. Cl.[6] ..... E21B 17/01; E21B 17/20; E21B 19/22; E21B 43/01

[52] U.S. Cl. ..... 405/165; 166/77.2; 166/384; 166/346; 166/359; 175/7; 405/195.1

[58] Field of Search ..... 405/165, 195.1; 175/5, 7, 9, 103, 220; 166/77.1, 77.2, 77.3, 384, 346, 359, 367

[56] References Cited

U.S. PATENT DOCUMENTS

| | | | |
|---|---|---|---|
| 3,559,905 | 2/1971 | Palynchuk | 166/77.3 X |
| 3,677,345 | 7/1972 | Sizer | 166/315 |
| 3,724,567 | 10/1973 | Smitherman | 177/77.3 X |
| 3,777,827 | 12/1973 | Thiery et al. | 175/103 |
| 4,556,340 | 11/1985 | Morton | 405/195 |
| 4,634,314 | 1/1987 | Pierce | 405/195.1 |
| 4,730,677 | 3/1988 | Pearce et al. | 166/345 |
| 4,848,455 | 7/1989 | Fenyvesi | 166/77.2 |
| 4,917,540 | 4/1990 | Recalde | 405/168 |

FOREIGN PATENT DOCUMENTS 0244048 11/1987 European Pat. Off. ..... E21B 17/01

OTHER PUBLICATIONS

Falcimaigne, "High Performance Composite Pipes For Deep Water Multiline Production Risers", pp. 39–44.

Sparks et al., "High Performance Composite Tubes For Deepwater Risers", pp. 723–732.

Brooks et al., "Research & Development in Riser Systems", pp. 1–12.

*Primary Examiner*—Stephen J. Novosad

*Attorney, Agent, or Firm*—Jack L. Hummel; Jack E. Ebel

[57] ABSTRACT

A system and method is provided for storing a continuous length of an assembled jointed tubular conduit on an offshore vessel and for conveying the tubular conduit between the deck of the vessel and a subsurface wellhead on the floor of the body of water. The system includes a carousel positioned around the perimeter of the vessel defining a continuous close-curved carousel pathway in parallel or coplanar alignment with the horizontal deck. The assembled tubular conduit is maintained in coiled storage along the carousel pathway until it is desired to convey the tubular conduit into or out of the carousel. Horizontal and vertical directing means are provided that, in cooperation with rotation of the carousel, enable uncoiling of the tubular conduit from the carousel into the water or recoiling of the tubular conduit into the carousel from the water. The horizontal directing means is positioned proximal to the carousel, engaging the tubular conduit and defining a substantially horizontal curved pathway for the tubular conduit, thereby redirecting the tubular conduit in a linear radial direction relative to the circumferential carousel pathway. The vertical directing means is positioned proximal to the deck opening, engaging the tubular conduit and defining a vertical curved pathway for the tubular conduit, thereby redirecting the tubular conduit in a linear perpendicular direction relative to the carousel pathway.

38 Claims, 8 Drawing Sheets

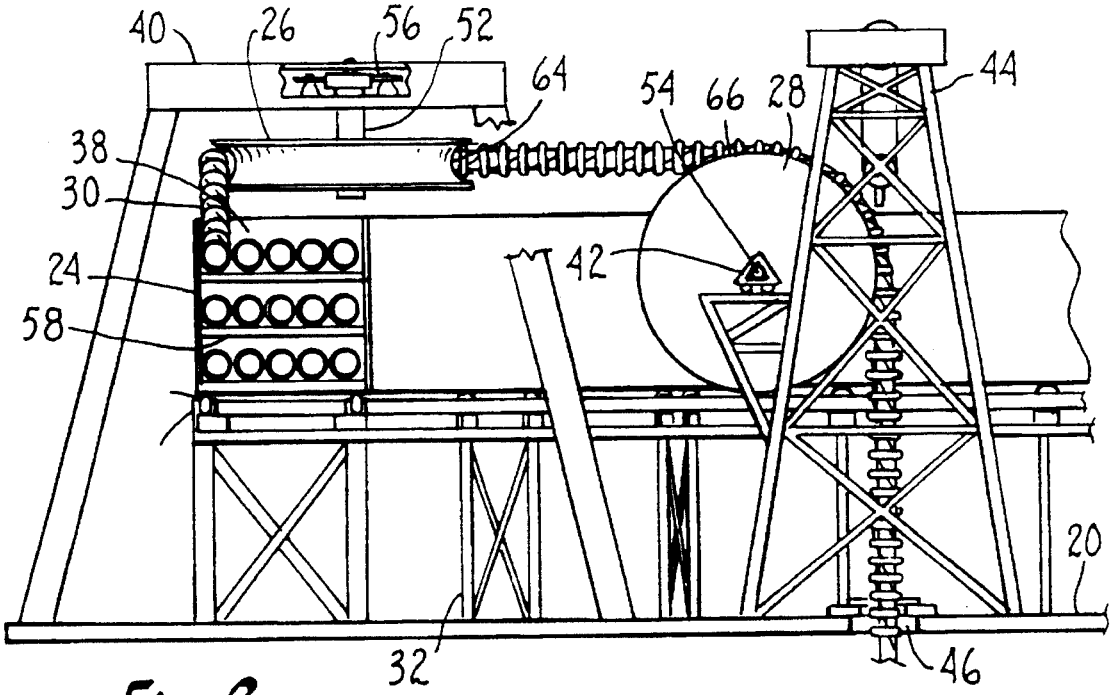
Fig. 2
Fig. 3
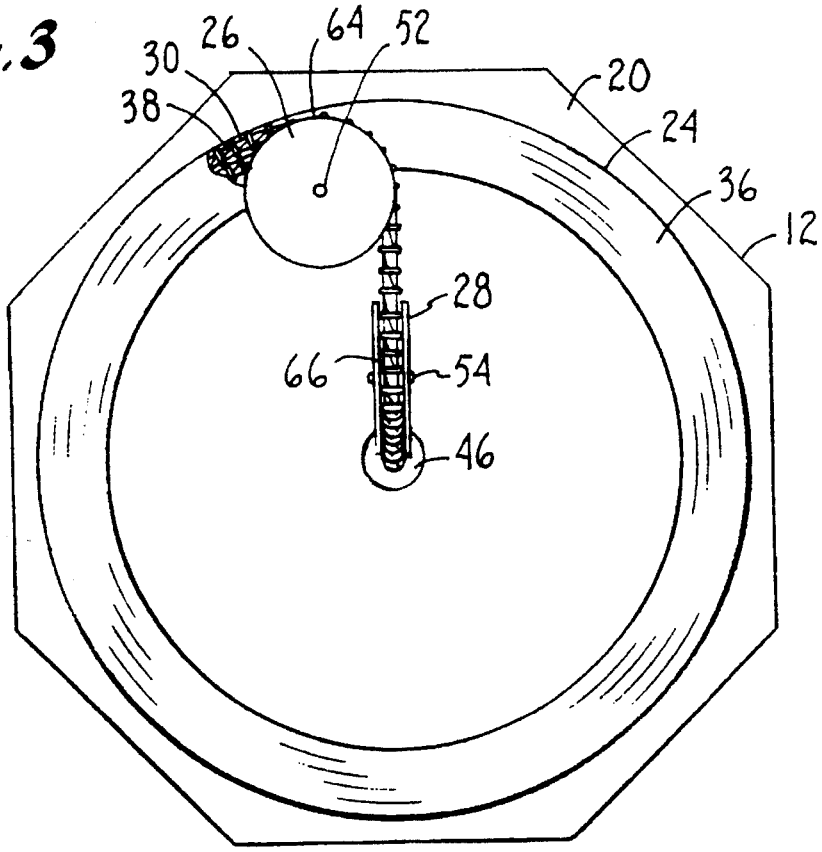

64
26
76
74
70
30
20
72
34
84
82
80

OFFSHORE SYSTEM AND METHOD FOR STORING AND TRIPPING A CONTINUOUS LENGTH OF JOINTED TUBULAR CONDUIT

BACKGROUND OF THE INVENTION

1. Technical Field

The present invention relates generally to the recovery of offshore hydrocarbons, and more particularly, to an offshore system and method for storing a continuous length of jointed tubular conduit and for tripping the continuous length of jointed tubular conduit down to or up from a subsurface well utilized in the production of hydrocarbons.

2. Background Information

Offshore hydrocarbon exploration is presently yielding an increasing number of reserves in deepwater regions, which are generally defined as offshore regions having water depths greater than about 600 meters. There are, however, a myriad of operational and economic complexities associated with the exploitation of deepwater hydrocarbon reserves that conventional drilling and production technologies do not adequately address. For example, many drilling, production, and well servicing applications require placement of a tubular conduit, termed a riser, that extends from the operating deck of a fixed or floating surface structure to the marine floor. The riser serves as an access conduit through the water column from the operating deck to the subsurface wellhead for the support and protection of drillstrings, production strings, service tools, or the like.

Currently, most risers are constructed from high-strength steel. Although steel risers generally perform satisfactorily in shallow or moderate water depths, the use of steel risers in deepwater operations, where water depths can exceed 1000 meters, becomes problematic. Because deepwater operations require risers of extraordinary length to reach the marine floor, the excessive weight of such long length risers becomes a limiting operational parameter. The problem is particularly acute in drilling operations where floating vessels, such as drill ships or semisubmersibles, are commonly used to support the drilling riser and the associated drillstring. Extremely large drilling vessels are required to adequately support the weight of conventional steel drilling risers and drillstrings in deep water. However, in many cases, the use of large-scale drilling vessels is economically impractical because such vessels are costly to build and maintain and, therefore of limited availability.

In response to this problem, drilling risers have been developed from alternate materials that have an equivalent or greater strength than steel, yet are considerably lighter, thereby significantly reducing the weight load on the drilling vessel in deepwater applications. Such alternate riser materials are generically termed "composites," of which particular types are described in U.S. Pat. No. 4,634,314 and European Patent Application EP 0 244 048 A2. In addition to having characteristics of low density and high mechanical strength, composites also have favorable corrosion and fatigue resistant properties, rendering them potentially desirable even in shallower water applications. Other composites useful in the fabrication of risers having utility in deepwater applications are described in a number of literature references including Sparks et al., "High Performance Composite Tubes For Deepwater Risers"; Falcimaigne, "High Performance Composite Pipes For Deep Water Multiline Production Risers"; and Brookes et al., "Research & Development In Riser Systems". These references emphasize the particular effectiveness of risers fabricated from composites for use in association with floating vessels, such as semisubmersibles, because composites are generally more compliant than their steel counterparts and, thus, more adaptable to movement of the floating vessel due to motion of the body of water in which the floating vessel resides.

The advancement of composites for the fabrication of relatively lightweight, high-strength risers has made inroads toward eradicating a primary technological impediment to the exploitation of deepwater hydrocarbon reserves. Nevertheless, the cost of conventional methods for on-site storage, installation and retrieval of tubular conduit for deepwater applications, whether fabricated from steel or composites, remains a significant impediment to the exploitation of deepwater hydrocarbon reserves. For example, drilling risers are conventionally stored on-site by stacking the riser as disassembled straight sections of tubular conduit on the deck of the support vessel. The riser is subsequently installed by tripping it from the surface to the wellhead in a section-by-section process termed stalking, wherein each new section of the riser is positioned on its end atop the deck of the surface structure and assembled to the end of the preceding section extending into the water. The procedure is repeated one section at a time until the assembled riser extends substantially the entire distance from the deck to the wellhead. If it is desired to retrieve the riser, it is tripped back to the surface in the reverse procedure, disassembling the riser section-by-section as the riser is drawn up from the wellhead to the deck until the entire riser has been removed from the water and disassembled on the deck. It is apparent that tripping a long length riser in this manner for deepwater applications is extremely time consuming due to the large number of sections making up the riser, each of which must be individually handled. Any activity that increases time consumption translates directly to added cost because the drilling rig, crew and equipment must remain on-site during the tripping operation and drilling activity must be suspended while the riser is being tripped. In addition, the space required to stack the disassembled riser sections during on-site storage may exceed the available storage space of the drilling vessel, thereby requiring a stand-by support vessel for storage of sufficient riser sections to make up the needed length of assembled riser. The required presence of a support vessel unduly adds to the cost of the drilling operation. Accordingly, the present invention recognizes a need for less time consuming and more cost-effective means for tripping a tubular conduit between the deck of a surface structure and a subsurface wellhead and further recognizes the need for a less space-intensive and more cost-effective means for storing a tubular conduit at an offshore site.

A number of alternate methods, other than the above-described stalking method, are known for storing and deploying tubular conduit in marine environments. U.S. Pat. No. 3,777,827 discloses an apparatus for storage of a continuous flexible drill pipe in an on-site basket surrounding the drilling rig and for deployment of the drill pipe in a subterranean or subsea borehole while supplying a drilling fluid to the drill pipe. U.S. Pat. No. 4,917,540 discloses an apparatus for storing a rigid pipeline on a shipboard reel and laying the pipeline along the ocean floor while straightening and adjusting the tension thereof. U.S. Pat. No. 4,730,677 discloses an apparatus for storing a flexible riser on a powered reel of a support ship and deploying the riser from the ship to the wellhead of a completed wellbore for maintenance or servicing of the wellbore with either wireline or through the flow line tools. None of the above-recited apparatuses for storing and deploying tubular conduit, however, relates to the specific performance requirements for storing, installing or retrieving continuous lengths of jointed drilling risers in deepwater environments. In particular, the prior art neither recognizes nor addresses the unique problems attributable to the magnitude of an offshore drilling riser storage and tripping operation with respect to the extreme length required of the riser for deepwater applications. Nor does the prior art recognize or address the unique problems attributable to the fact that offshore drilling risers typically have external lines such as choke and kill lines extending coaxially with the riser that require special attention during the tripping operation to avoid damaging the lines.

As such, it is an object of the present invention to provide an apparatus and method for storing and deploying a tubular conduit offshore in a time-efficient and cost-effective manner. More particularly, it is an object of the present invention to provide an apparatus and method for storing a continuous jointed drilling riser or a continuous jointed drillstring on the deck of a floating drilling vessel and for tripping the drilling riser or drillstring between the deck and a subsurface wellhead in a time-efficient and cost-effective manner. It is another object of the present invention to provide an apparatus and method for storing and tripping a tubular conduit having specific utility to semisubmersibles. It is still another object of the present invention to provide an apparatus and method for storing and tripping a tubular conduit having specific utility to a deepwater marine environment. It is yet another object of the present invention to provide an apparatus and method for tripping a continuous jointed drilling riser within a marine environment, wherein the riser can be broken at its joints to remove a section for service or replacement thereof. It is yet a further object of the present invention to provide a time-efficient and cost-effective apparatus and method for storing and tripping a continuous jointed drilling riser within a marine environment, wherein the riser has one or more external lines associated therewith. It is a still further object of the present invention to provide a continuous jointed drillstring that is compatible with the apparatus and method for storage and deployment thereof. These objects and others are achieved in accordance with the invention described hereafter.

SUMMARY OF THE INVENTION

The present invention is a system and method for storing a continuous jointed tubular conduit on an offshore structure positioned at the surface of a body of water. In addition, the invention is a system and method for conveying the tubular conduit between the structure and a wellhead on the floor of the body of water, enabling the operator to trip the continuous jointed tubular conduit from the surface structure down to the wellhead in an installation mode, or from the wellhead back up to the surface structure in a retrieval mode. The system comprises a surface structure, which is preferably a floating vessel, such as a semisubmersible, having a base residing in the water below the surface in substantially vertical alignment with the wellhead on the floor below. The base supports a deck of the vessel above the water surface in a substantially horizontal orientation, parallel to the water surface and the subsurface floor. The deck has an opening therethrough, providing access to the water from the deck.

The system further comprises a carousel positioned around the perimeter of the vessel defining a substantially continuous close-curved carousel pathway in substantially parallel or coplanar alignment with the deck. The carousel pathway is dimensioned to exceed the minimum bend radius of a selected jointed tubular conduit, enabling the jointed tubular conduit to be coiled along the carousel pathway for storage thereof in a substantially continuous assembled length. The carousel has a drive mechanism for rotating the carousel when it is desired to install the tubular conduit from storage or to retrieve the tubular conduit back into storage. Horizontal and vertical directing means are provided that, in cooperation with rotation of the carousel, enable uncoiling of the tubular conduit from the carousel into the water during installation or recoiling of the tubular conduit into the carousel from the water during retrieval. The horizontal directing means is positioned proximal to the carousel, engaging the tubular conduit and defining a substantially horizontal curved pathway for the tubular conduit, thereby redirecting the tubular conduit in a substantially linear radial direction relative to the circumferential carousel pathway. The vertical directing means is positioned proximal to the deck opening, engaging the tubular conduit and defining a substantially vertical curved pathway for the tubular conduit, thereby redirecting the tubular conduit in a substantially linear perpendicular direction relative to the carousel pathway.

In the installation mode of operation, the drive mechanism for the carousel is activated to rotate the carousel in a direction that causes the coiled tubular conduit to be fed from the carousel to the horizontal directing means. The horizontal directing means engages the tubular conduit and redirects the path thereof in a linear radially inward direction to the vertical directing means. The vertical directing means in turn engages the tubular conduit and redirects the path thereof in a linear perpendicular downward direction through the deck opening into the water. Rotation of the carousel continues until the tubular conduit extends from the deck to the subsurface wellhead. In the retrieval mode of operation, the drive mechanism for the carousel is reactivated, but the carousel is rotated in an opposite direction causing the tubular conduit to be reeled back into the carousel from the subsurface wellhead. The vertical directing means engages the tubular conduit through the deck opening, draws the tubular conduit out of the water in a perpendicular upward direction relative to the carousel pathway, and redirects the path of the tubular conduit in a linear radial outward direction toward the horizontal directing means. The horizontal directing means in turn engages the tubular conduit and redirects the path thereof tangentially into the carousel. Rotation of the carousel continues until the tubular conduit has been withdrawn from the water back into the carousel.

The above-described system and method encompass a number of different specific embodiments. In accordance with a first two alternate embodiments, the horizontal directing means is a horizontal sheave aligned substantially parallel to the carousel pathway and the vertical directing means is a vertical sheave aligned substantially perpendicular to the carousel pathway. In one of these embodiments, the horizontal sheave is maintained in a precise parallel position over the carousel by an overhead mount that permits radial, but not vertical, displacement of the horizontal sheave relative to the carousel. The vertical sheave is maintained in a substantially perpendicular position over the deck opening by a motion compensating mount that enables some variation in the position of the vertical sheave to account for movement of the vessel due to motion of the water. In the other of these embodiments, the horizontal sheave has a fixed mounting at a reduced height, substantially parallel with, and radially offset from, the carousel. A radially displaceable fairlead is provided to direct the tubular conduit from the carousel into the horizontal sheave and vice versa.

Although the horizontal sheave is substantially parallel with the carousel pathway, it is nevertheless somewhat tilted in the direction of the fairlead to assist operation thereof. As before, the vertical sheave is maintained in a substantially perpendicular position over the deck opening by the motion compensating mount. An additional conveyance means may also be provided to lift the tubular conduit from the horizontal sheave to the vertical sheave insofar as the redirection surface of the horizontal sheave is significantly lower than the redirection surface of the vertical sheave.

In another embodiment of the system, dual carousels are provided, wherein two concentric carousels are positioned around the perimeter of the vessel, each having a separate drive mechanism enabling independent rotation thereof and each retaining separate tubular conduits. A single set of horizontal and vertical directing means substantially as described in either embodiment above is provided for both carousels. Engagement of the desired tubular conduit by the horizontal directing means to enable tripping thereof is achieved by appropriate radial positioning of the horizontal sheave in the case of the radially displaceable overhead embodiment of the horizontal sheave or by appropriate radial positioning of the fairlead in the case of the fixed radial embodiment of the horizontal sheave.

In yet another embodiment of the system, an arcuate vertical conveyor is substituted for the vertical sheave of the single or dual carousel system described above. The arcuate vertical conveyor, like the vertical sheave, is aligned substantially perpendicular to the carousel pathway(s). In accordance with this embodiment, the vertical conveyor is mounted on a tractor for radial displacement of the vertical conveyor relative to the deck opening. The vertical conveyor is selectively positionable by means of the tractor in an operable position in vertical alignment with the deck opening or in an inoperable position out of vertical alignment with the deck opening.

In a still further embodiment of the system, separate sets of horizontal and vertical direction means are provided for each tubular conduit of the dual carousel system. The two sets of horizontal and vertical directing means are opposingly mounted on the deck about the opening. Both horizontal directing means are horizontal sheaves and either one or both of the vertical direction means can be a vertical sheave or an arcuate vertical conveyor as described in one of the embodiments above. Where an arcuate vertical conveyor is employed for each tubular conduit, one vertical conveyor is positioned in an inoperable position relative to the deck opening whenever the opposing vertical conveyor is positioned in an operable position and vice versa so that the inoperable vertical conveyor does not interfere with the operable vertical conveyor as the conveyor trips its respective tubular conduit.

Although the present system and method as described above, are generally applicable to many types of tubular conduit used in hydrocarbon recovery applications, the system and method have specific utility to drilling applications and to drilling risers and drillstrings as employed on semisubmersibles. A drilling riser particularly suitable for the present invention is a continuous jointed tubular conduit formed from composites. The jointed riser is assembled from many sections of tubular conduit joined together by flanges, couplings, or other types of removable connectors at their ends. To facilitate smooth engagement of the riser with the horizontal and vertical directing means as well as to protect the outer surface of the riser during tripping operations, a plurality of spaced apart circumferential protuberances may be affixed to the outer surface of the riser. The directing means, and in particular the vertical directing means, may correspondingly be provided with means such as rounded teeth that enhance engagement of the vertical directing means with the protruding flanges of the riser, thereby enabling the directing means to grip the flanges of the riser during operation of the system. The protuberances may be formed from materials that are substantially more buoyant than the tubular conduit to enhance the buoyancy characteristics of the riser.

It is also noted that drilling risers are typically associated with one or more tubular utility lines, such as choke and kill lines, extending coaxially along the outer surface of the riser. In order to prevent damage to the utility lines due to overtension or overcompression as the riser is redirected in accordance with the present invention, the utility lines are helically configured about the riser. In furtherance of this embodiment, the utility lines are desirably threaded through the protuberances disposed on the surface of the riser, enabling the protuberances to maintain the position of the utility lines relative to the riser. The invention will be further understood, both as to its structure and method of use, from the accompanying drawings and description.

BRIEF DESCRIPTION OF THE DRAWINGS

FIG. 2 is an elevational view of the system of FIG. 1 shown in partial cross-section.

FIG. 3 is a partial plan view of the system of FIG. 1.

DESCRIPTION OF PREFERRED EMBODIMENTS

The present invention relates to a system and method for storing a continuous jointed tubular conduit on an offshore vessel and conveying the tubular conduit between the vessel positioned on the surface of a body of water and a wellhead on the subsurface floor of the body of water. The invention is shown herein applied to a drilling riser or drillstring being tripped to or from a semisubmersible, but it is understood that the present invention has general application to other types of hydrocarbon recovery-related tubular conduit and floating vessels or fixed platforms. The present invention has specific application to any mobile drilling vessel, generally termed a "MODU" (mobile offshore drilling unit) and inclusive of substantially any non-fixed drilling structure, such as drilling ships, semisubmersibles, and the like.

Figure 1:
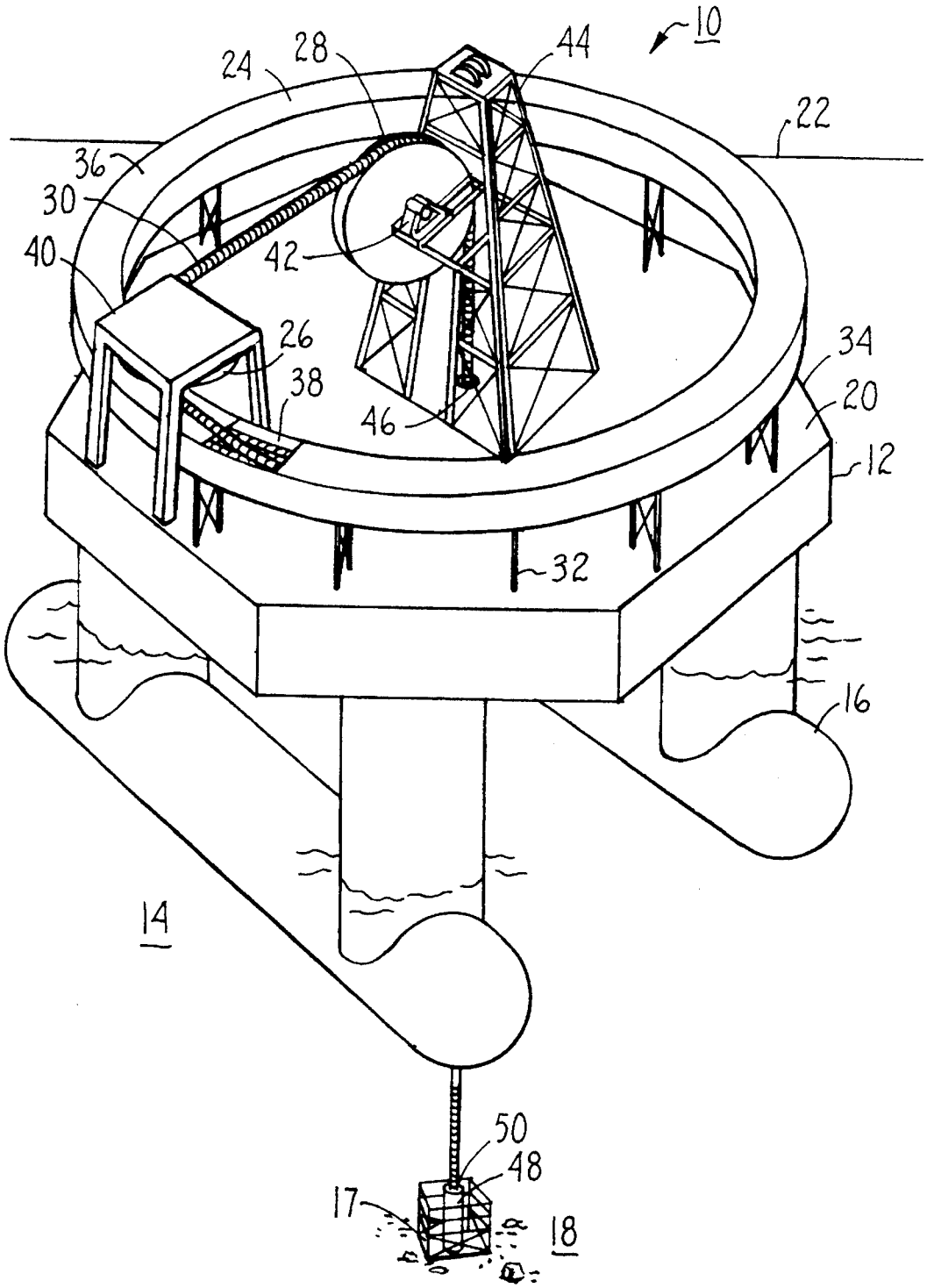
FIG. 1 is a perspective view of an embodiment of the system of the present invention positioned in a body of water.

Referring initially to FIG. 1, an embodiment of the system is shown and generally designated 10. The system comprises a semisubmersible 12 positioned in a body of water 14. The base 16 of the semisubmersible is anchored by conventional means (not shown) such that the semisubmersible 12 is in substantially vertical alignment with the wellhead 17 of a wellbore being drilled into the earthen floor 18 beneath the body of water 14. The semisubmersible 12 has a deck 20 supported by the base 16 above the surface 22 of the water in a substantially horizontal position parallel to the water surface 22. The remainder of the system 10 is mounted on the deck 20 and includes a carousel 24, a horizontal sheave 26, a vertical sheave 28, and a substantially continuous drilling riser 30 extendable from the carousel 24 and engagable with the sheaves 26, 28. The carousel 24 is rotatably mounted to the deck 20, supported by a plurality of pylons 32 all having substantially the same height, that maintain the carousel 24 in a horizontal position above the deck 20, substantially parallel to the deck 20. The carousel 24 has a circular shape defining a continuous close-curved pathway extending around the hexagonal perimeter 34 of the deck 20 in approximate correspondence to the perimeter 34. The carousel 24 is rotatable through a full range of 360° about the center of its circular pathway. A cover 36 is provided over the carousel 24 that is fixed relative to the deck 20 independent of the rotatable carousel 24. The cover 36 prevents intrusion of water or other foreign materials into the carousel 24. A breach 38 is provided in the cover 36 proximal to the horizontal sheave 26 permitting ingress or egress of the riser 30 into or out of the carousel 24, respectively.

The horizontal sheave 26 is a circular wheel having a groove formed in its circumferential periphery to receive the tubular riser 30. The horizontal sheave 26 is mounted above the breach 38 in a substantially parallel orientation relative to the deck 20 by means of an overhead mount 40 fixedly attached to the deck 20. The horizontal sheave 26 is preferably mounted to the overhead mount 40 at the center of the horizontal sheave 26 in a manner that permits full rotation of the horizontal sheave 26 through a range of 360° relative to the deck 20. A drive mechanism (not shown ) is provided to power rotation of the horizontal sheave 26. The overhead mount 40 also permits radial displacement of the horizontal sheave 26 relative to the deck 20 and carousel 24, but not vertical displacement thereof, such that the horizontal sheave 26 maintains at all times a fixed vertical distance from the deck 20 and carousel 24 and a parallel orientation thereto. The mounting axis, and correspondingly the axis of rotation, of the horizontal sheave 26 are substantially parallel to the axis of rotation of the carousel 24.

The vertical sheave 28 is also a circular wheel configured substantially identical to the horizontal sheave 26. In contrast to the horizontal sheave 26, however, the vertical sheave 28 is mounted above the deck 20 in a substantially perpendicular orientation relative to the deck 20 and carousel 24 by means of a motion compensating mount 42. The vertical sheave 28 is positioned on the motion compensating mount adjacent to the horizontal sheave 26 and radially inward relative to the horizontal sheave 26 and carousel 24. The motion compensating mount 42 is supported above the deck 20 by a derrick 44 positioned on the deck 20 within the interior of the circular carousel pathway. The vertical sheave 28 is preferably mounted to the motion compensating mount 42 at the center of the vertical sheave 28 in a manner that permits full rotation of the vertical sheave 28 through a range of 360° relative to the deck 20. A drive mechanism (not shown)is provided to power rotation of the vertical sheave 28. The motion compensating mount 42 also permits some displacement of the axis of rotation of the vertical sheave 28 relative to the subsea floor 18 and the riser 30, thereby compensating for motion of the semisubmersible 12 in correspondence with swells on the water surface 22 which could otherwise overstress the riser 30. Such motion compensating mounts are generally within the purview of the skilled artisan. The mounting axis, and correspondingly the axis of rotation, of the vertical sheave 28 are maintained substantially parallel to the axes of rotation of the carousel 24 and horizontal sheave 26 subject to the above-described variations attributable to the motion compensating mount.

The horizontal sheave 26 is shown to redirect the continuous riser 30 from the circular carousel pathway in a linear radial inward direction as the riser 30 extends from the carousel 24. The vertical sheave 28 is subsequently shown to redirect the riser 30 from the linear radial inward direction in a linear downward vertical direction as the riser 30 extends from the horizontal sheave 26. As the riser 30 continues its downward vertical direction past the vertical sheave 28, the riser 30 follows the longitudinal axis of the derrick 42, passes through an opening 46 in the deck 20 above the water surface 22, and extends through the body of water 14 to the top of the wellhead 17 at the subsea floor 18. A blowout preventer and stress joint 48 are shown fitted to the wellhead 17 and the bottom end 50 of the riser 30 is joined with the blowout preventer and stress joint 48 in accordance with methods known to the skilled artisan. The magnitude of the system 10 described herein is such that the carousel 24 has sufficient diameter and volume to accommodate an entire coiled length of continuous tubular drilling riser 30 without over stressing it. Similarly, the sheaves 26, 28 have sufficient diameters and radii of curvature to avoid overstressing the riser 30 when it is redirected around the sheaves 26, 28. The absolute dimensions of the system 10 are dependent on the water depth and the minimum bend radius of the riser 30 which in turn varies as a function of the riser design and configuration. The riser 30, however, is preferably fabricated from a composite material that is relatively more flexible than conventional steel, although the composite material of the riser is not deemed "flexible" as the term is generally defined in the hydrocarbon drilling and production arts. Specific designs and configurations of drilling risers having utility herein are described below.

An exemplary semisubmersible 12 having utility in the present invention typically has a deck 20 with a diameter on the order of about 90 meters. An exemplary drilling riser 30 has an outside diameter on the order of about 1 meter. Accordingly, the carousel 24 is dimensioned in correspondence with the deck 20, enabling storage of the continuous jointed riser 30 by coiling the riser 30 in layers within the carousel 24 in a continuous length substantially corresponding to the water depth at the location of the semisubmersible 12. A radius for each sheave 26, 28 on the order of about 18 meters is generally sufficient to accommodate the minimum bend radii of drilling risers 30 contemplated by the present invention. It is understood, however, that the above-described dimensions are merely exemplary to demonstrate the scope and utility of the present invention and are not to be construed as limiting the scope thereof. As is apparent to the skilled artisan, a range of dimensions for the system 10 are possible within the scope of the present invention to accommodate variations in the water depth and the design and configuration of the riser in addition to variations in other operational parameters.

Further details of the carousel 24, horizontal sheave 26, vertical sheave 28, riser 30, overhead mount 40, motion compensating mount 42 and their intercooperative relation are described with reference to FIGS. 2 and 3 in conjunction with FIG. 1. For clarity, the mounts 40, 42 and derrick 44 have been omitted from FIG. 3. The horizontal sheave 26 is rotatably mounted to the overhead mount 40 by means of a centrally positioned mounting pin 52 serving as a pivot extending from the overhead mount 40 through the horizontal sheave 26 The vertical sheave 28 is likewise rotatably mounted to the motion compensating mount 42 by means of a centrally positioned mounting pin 54 extending from the motion compensating mount 42 through the vertical sheave 28. The carousel 24 has an open box-like configuration with the continuous drilling riser 30 coiled therein. The mounting pin 52 of the horizontal sheave 26 is connected to a radial drive mechanism 56 that is capable of selectively radially repositioning the horizontal sheave 26 to align it with the coiled riser 30 as it is fed to the carousel 24 or withdrawn therefrom. In the present case, the drilling riser 30 is shown coiled in three layers within the carousel 24, each layer separated by a horizontal shelf 58 having a breach (not shown) aligned with the breach 38 in the cover 36 to enable access to the shelf 58. The invention, however, is not limited to any specific configuration of shelves or coiled layering within the carousel 24. The carousel 24 is further provided with a pair of rails 60 on its bottom side that are received by a pair of corresponding slotted guides 62 mounted atop each pylon 32. Rotation of the carousel 24 is enabled by driving the rails 60 through the guides 62 with a drive motor (not shown). It is noted that the carousel 24, horizontal sheave 26 and vertical sheave 28 are relatively positioned such that the surfaces 64, 66 for engagement of the riser 30 on the horizontal and vertical sheaves 26, 28, respectively, are aligned at substantially the same height.

Figure 4:
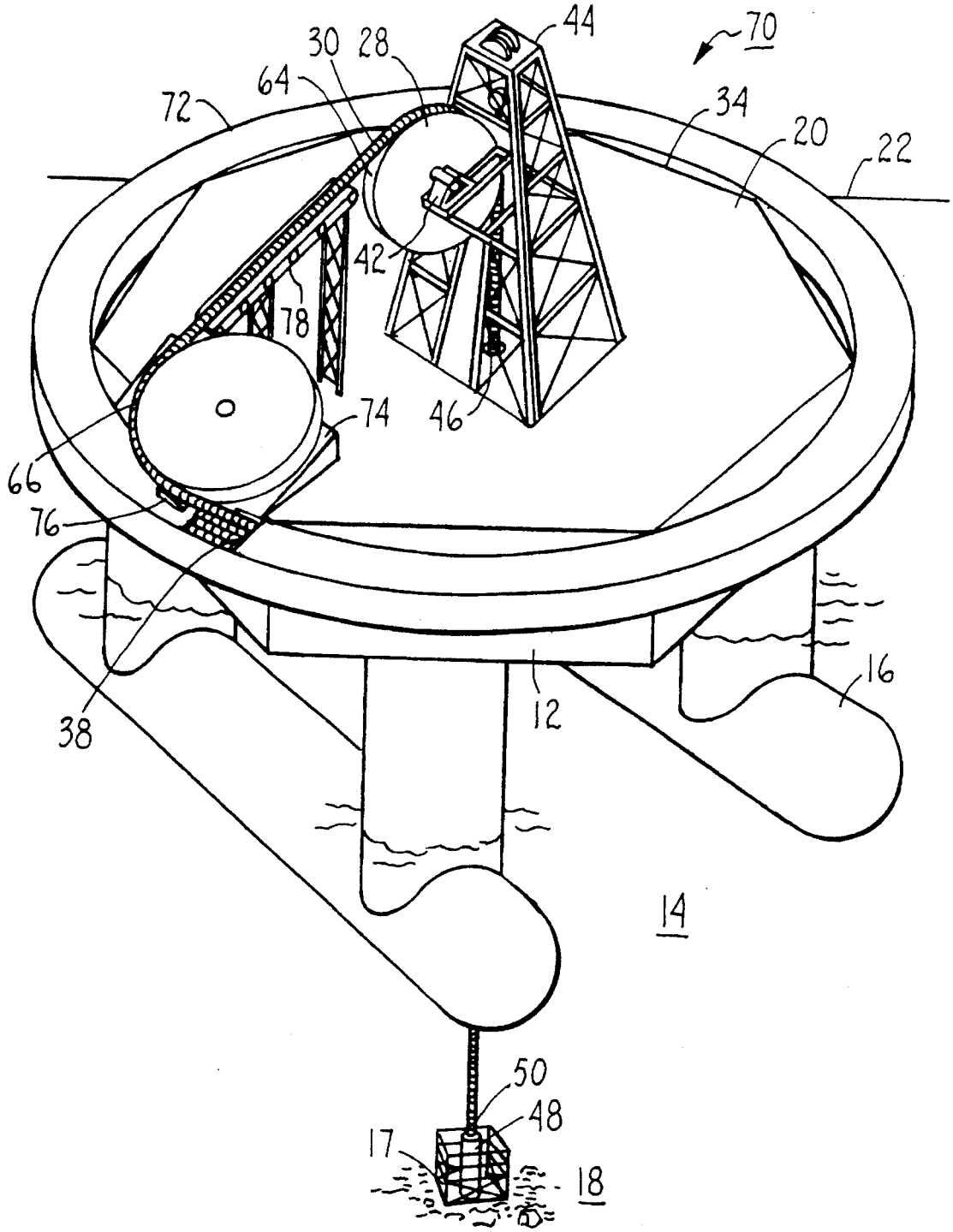
FIG. 4 is a perspective view of another embodiment of the system of the present invention positioned in a body of water.

A further embodiment of the system of the present invention is shown with reference to FIG. 4 and generally designated 70. Components of the system 70 common to the system 10 are identified in FIG. 4 by the same reference characters as FIGS. 1–3. The system 10 and the system 70 are substantially similar insofar as both systems 10, 70 include a semisubmersible, carousel, horizontal and vertical sheaves, and a drilling riser. The system 70, however, is modified by providing an expanded carousel 72. The carousel 72 is positioned around the perimeter 34 of the deck 20, like the carousel 24, but the carousel 72 is sufficiently larger than the carousel 24 to substantially enclose the entire perimeter 34 in a substantially coplanar relation with the deck 20.

The horizontal sheave 26 is correspondingly mounted on the deck 20 at about substantially the same distance above the carousel 72 as the distance of the horizontal sheave 26 above the carousel 24 in the system 10. The horizontal sheave 26 is mounted on the deck 20 adjacent and radially inward from the breach 38 in a substantially parallel orientation relative to the deck 20 by means of a fixed mounting slab 74 that lays flat on the deck 20. The horizontal sheave 26 is preferably mounted to the mounting slab 74 at the center of the horizontal sheave 26 in a manner that permits full rotation of the horizontal sheave 26 through a range of 360° relative to the deck 20. The horizontal sheave 26, however, is radially and vertically fixed relative to the deck 20 and carousel 72 by the mounting slab 74. Although the horizontal sheave 26 is in a substantially parallel orientation relative to the deck 20 and carousel 72, it is not precisely parallel thereto, but is slightly tilted toward the breach 38 to facilitate feeding of the drilling riser 30 to the carousel 72 or withdrawal therefrom. A fairlead 76 is positioned over the breach 38 adjacent to the horizontal sheave 26 at an incline to lead the riser 30 into or out of the carousel 72. The fairlead 76 is selectively radially displaceable to align it with the coiled riser 30 as it is fed to the carousel 72 or withdrawn therefrom, providing a capability similar to that of the radially displaceable horizontal sheave 26 and overhead mount 40 of the system 10.

The vertical sheave 28 of the system 70 is mounted in substantially an identical manner and orientation as the vertical sheave 28 of the system 10. Accordingly, the horizontal sheave 26 and vertical sheave 28 of the system 70 are relatively positioned such that the engagement surface 64 for the riser 30 on the horizontal sheave 26 is at a substantially lower height than the engagement surface 66 for the riser 30 on the vertical sheave 28. A motorized conveyor belt 78 is provided between the horizontal and vertical sheaves 26, 28 to augment lifting of the riser 30 from the engagement surface 64 on the horizontal sheave 26 to the engagement surface 66 on the vertical sheave 28.

Figure 5:
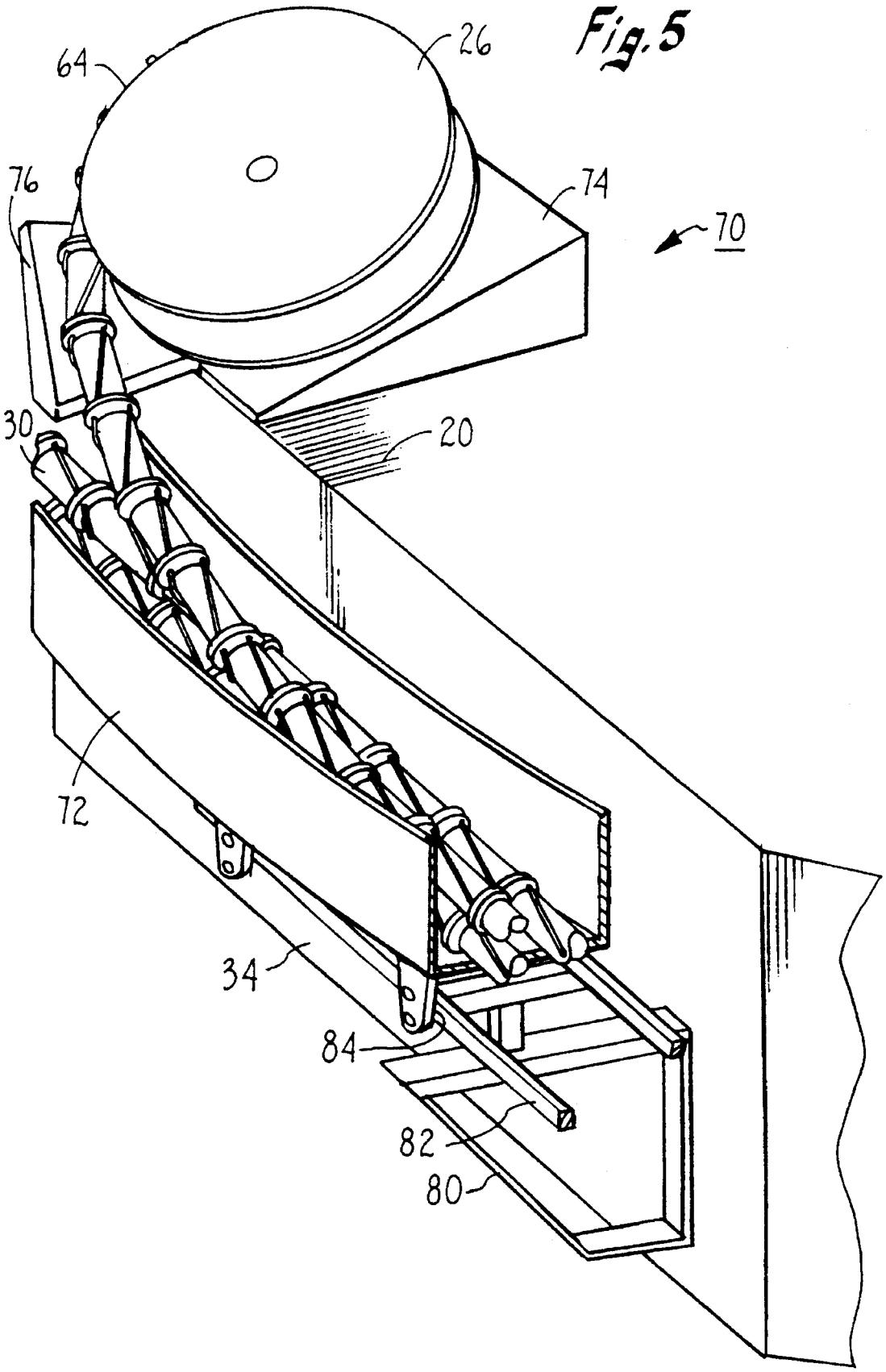
FIG. 5 is a partial perspective view of the system of FIG. 4 shown in cut away.
Figure 6:
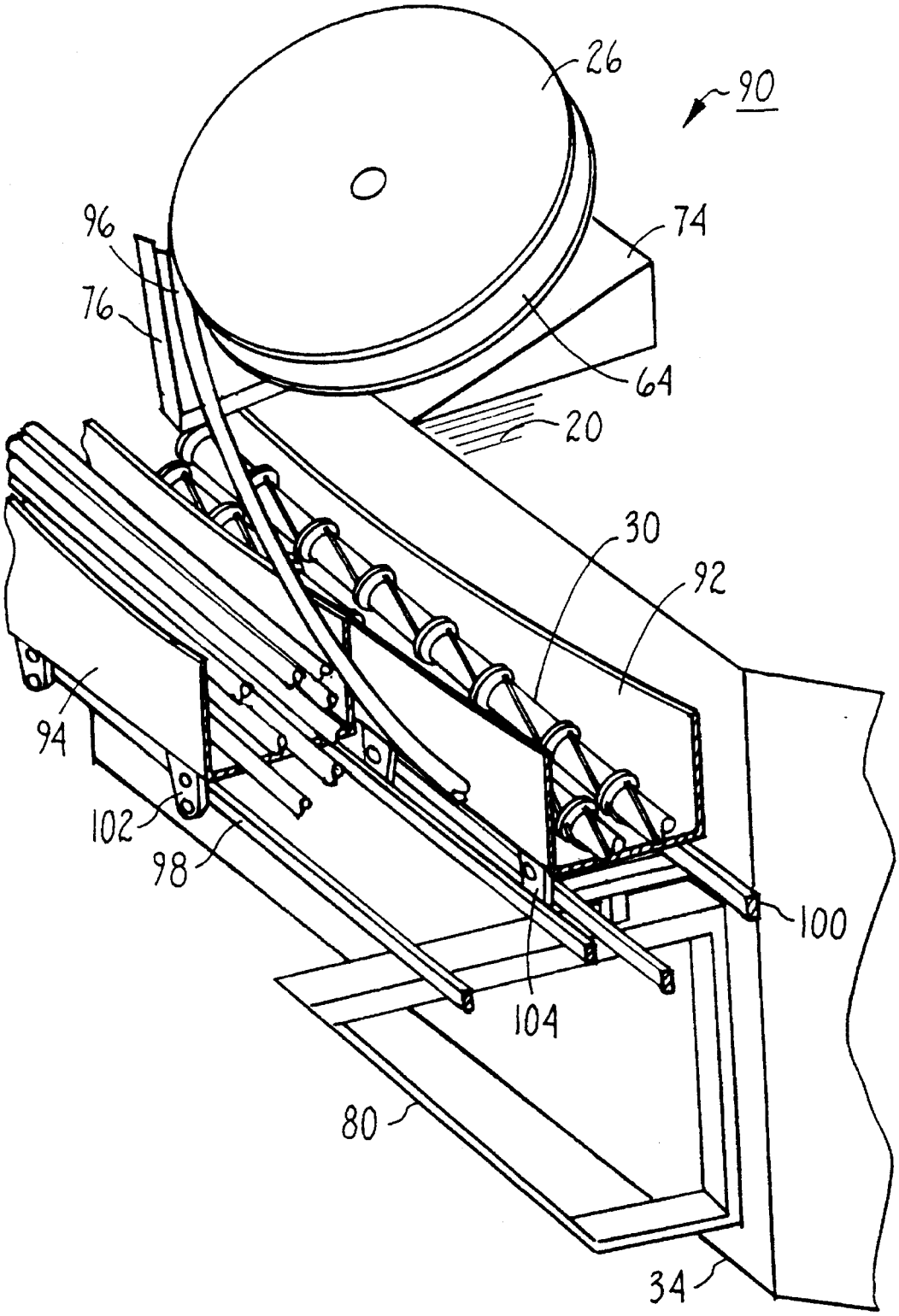
FIG. 6 is a partial perspective view of another embodiment of the system of the present invention shown in cut away.

A portion of the carousel 72 and horizontal sheave 26 of the system 70 is shown in greater detail in FIG. 5 For purposes of illustration the drilling riser 30 is shown truncated within the carousel 72, but it is understood that the riser 30 is continuous around the length of the carousel 72. The carousel 72 is supported by a plurality of trusses 80 extending radially outward from the perimeter 34 of the deck 20. The carousel 72 is driven around the continuous close-curved carousel pathway along rails 82 and guides 84 in a manner substantially similar to the carousel 24 of the system 10, although the position of the rails 82 and guides 84 of the system 70 are reversed with the guides 84 attached to the carousel 72 and the rails 82 attached to the trusses 80. In furtherance of this embodiment, the utility lines are desirably threaded through the protuberances disposed on the surface of the riser, enabling the protuberances to maintain the position of the utility line relative to the riser. Components of the system 90 common to the systems 10 and 70 are identified in FIG. 6 by the same reference characters as FIGS. 1–5. The system 70 and the system 90 are substantially similar, but the system 90 employs two concentric carousels 92, 94 around the perimeter 34 of the deck 20. Each carousel 92, 94 accommodates a different continuous tubular conduit that is separately fed to or withdrawn from the respective carousel 92, 94. The carousel 92 retains the drilling riser 30, while the carousel 94 retains a continuous drillstring 96 Only a portion of the carousels 92, 94 and horizontal sheave 26 of the system 90 is shown in FIG. 6 insofar as the remainder of the system 90 is identical to the system 70 shown in FIG. 4. For purposes of illustration the drilling riser 30 and drillstring 98 are shown truncated within the carousels 92, 94 but it is understood that the riser 30 and drillstring 96 are continuous around the lengths of the carousels 92, 94, respectively. The carousels 92, 94 are separately driven around their respective continuous close-curved carousel pathways along rails 98, 100 and guides 102, 104 in substantially the same manner as the carousel 72 of the system 70. The fairlead 76 is selectively radially positioned over the desired carousel 92, 94 to enable selection of the tubular conduit 30 or 96 to be fed to its respective carousel 92, 94 or withdrawn therefrom.

Figure 7:
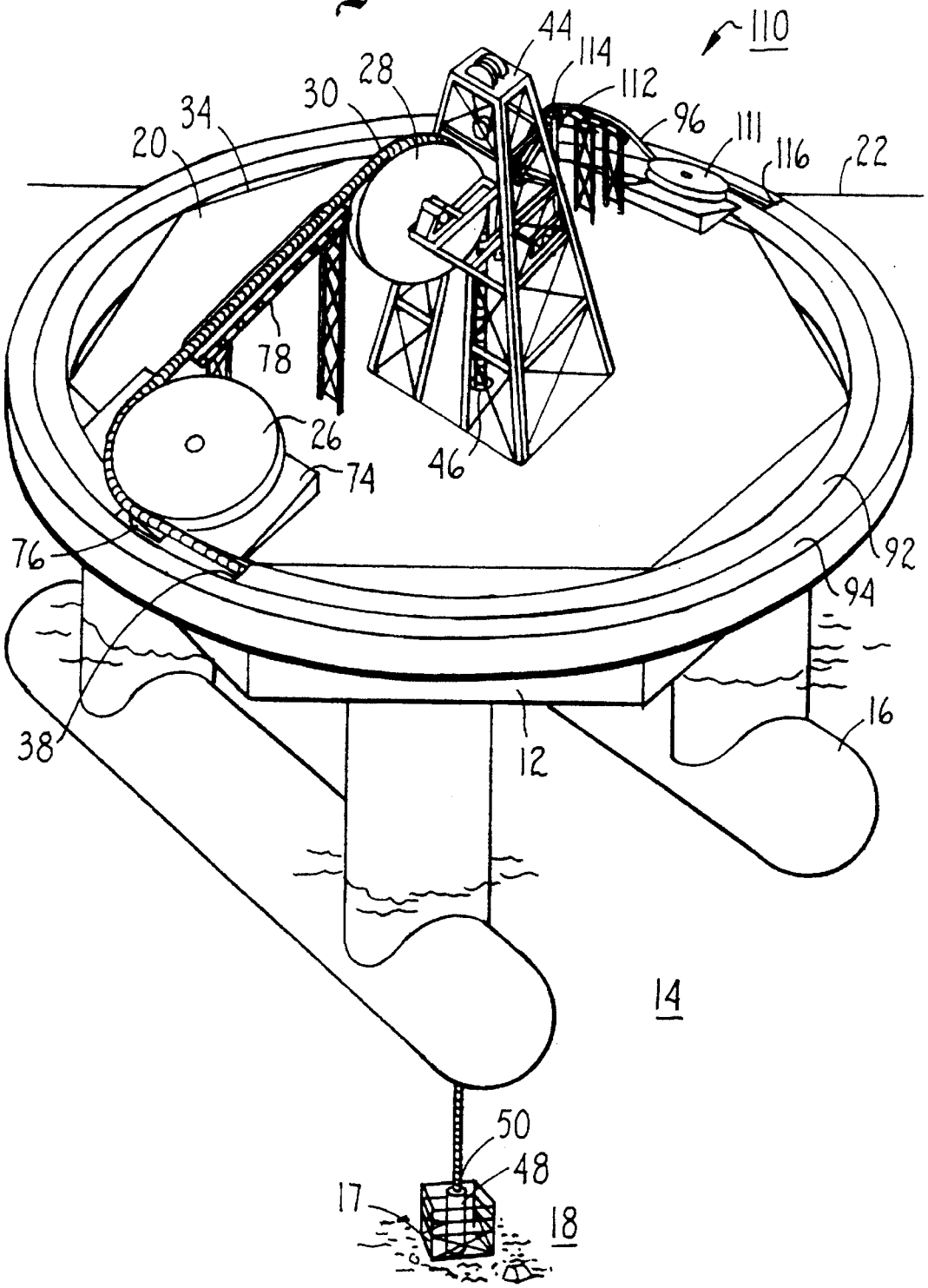
FIG. 7 is a perspective view of another embodiment of the system of the present invention positioned in a body of water.

A still further embodiment of the system of the present invention is shown with reference to FIG. 7 and generally designated 110. Components of the system 110 common to the systems 10, 70, 90 are identified in FIG. 7 by the same reference characters as FIGS. 1–6. The system 90 and the system 110 are substantially similar. The system 110, however, is modified by providing separate means for directing the respective tubular conduits, 30, 96 between the carousels 92, 94 and the subsea floor 18 via the deck opening 46 The riser 30 of the system 110 is provided with horizontal and vertical directing means substantially identical to the horizontal and vertical sheaves 26, 28 of the system 90. The horizontal and vertical directing means for the drillstring 96 are mounted on the deck 20 opposite the horizontal and vertical sheaves 26, 28. The horizontal directing means for the drillstring 96 is a horizontal sheave 111, substantially similar to the horizontal sheave 26. The vertical directing means for the drillstring 96 is an arcuate vertical conveyor 112 comprising a continuous rotatable belt 114 having a radius of curvature substantially equal to that of the vertical sheave 26. The drillstring 96 is withdrawn from or fed to the carousel 94 via a breach 116 correspondingly positioned opposite the breach 38 of the carousel 92.

Figure 8:
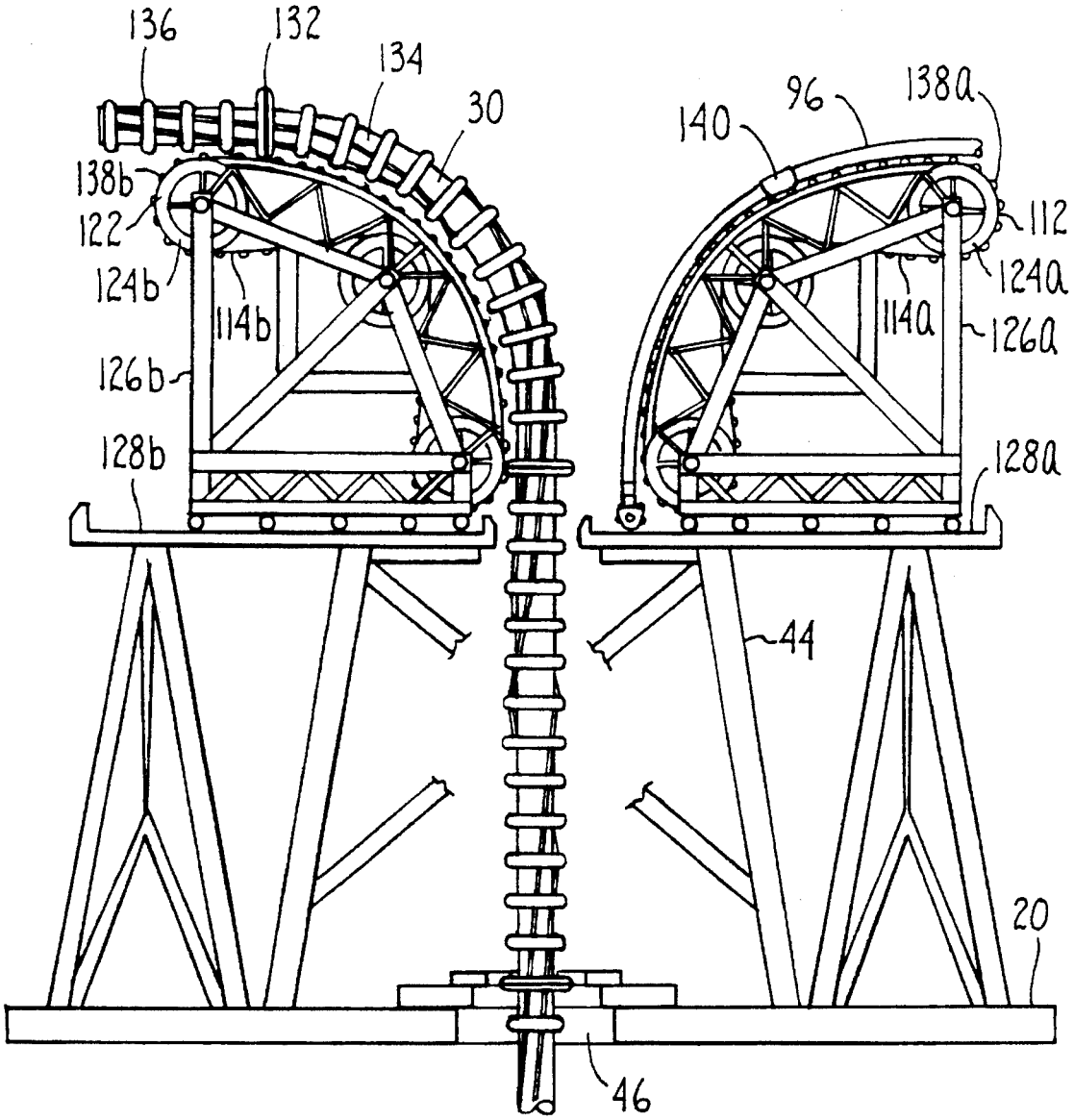
FIG. 8 is a partial elevational view of another embodiment of the system of the present invention.

Details of the arcuate vertical conveyor 112 are shown with reference to FIG. 8, wherein a portion of another embodiment of the system of the present invention is shown and generally designated 120. Components of the system 120 common to the systems 10, 70, 90, and 110 are identified in FIG. 8 by the same reference characters as FIGS. 1–7. The upper portion of the derrick 44, however, is omitted from FIG. 8 for clarity. The system 110 and the system 120 are substantially identical in all respects except that the system 120 substitutes an arcuate vertical conveyor 122 for the vertical sheave 26 as the vertical directing means for the drilling riser 30. The vertical conveyor 122 for the drilling riser 30 is likewise substantially identical to the vertical conveyor 112 except that the vertical conveyor 122 is adapted to direct the drilling riser 30, whereas the vertical conveyor 112 is adapted to direct the drillstring 96. Accordingly, both vertical conveyors 112, 122 are described with reference only to the vertical conveyor 112, it being understood that the same description applies to the vertical conveyor 122 as well. The components of the vertical conveyor 112 are designated by the suffix "a", while identical components of the vertical conveyor 122 are designated by the suffix "b".

In addition to the belt 114*a*, the arcuate vertical conveyor 112 is provided with a plurality of drive wheels 124*a* connected to a drive mechanism (not show) for rotating the belt 114*a*. The vertical conveyor 112 is radially displaceable relative to the deck opening 46 by means of a motor-driven tractor 126*a* rollable along a radially-directed linear elevated track 128*a*, upon which the vertical conveyor 112 is mounted. When it is desired to operate the vertical conveyor 112 for feeding the drillstring 96 to the carousel 94 or withdrawing the drillstring 96 therefrom, the tractor 126*a* is radially displaced inward along the track 128*a* until the drillstring 96 is vertically aligned with the deck opening 46 in an operable position, while the tractor 126*b* is radially displaced outward along the track 128*b* until the drilling riser 30 is out of vertical alignment with the deck opening 46 in an inoperable position. Conversely, when it is desired to operate the vertical conveyor 112 for feeding the riser 30 to the carousel 92 or withdrawing the riser 30 therefrom as shown in FIG. 8, the tractor 126*b* is radially displaced inward along the track 128*b* until the riser 30 is vertically aligned with the deck opening 46 in an operable position, while the tractor 126*a* is radially displaced outward along the track 128*a* until the drillstring 96 is out of vertical alignment with the deck opening 46 in an inoperable position.

The drilling riser 30 shown in FIG. 8 is particularly suitable for the present invention and comprises a continuous jointed tubular conduit formed from composites as are known to the skilled artisan. The riser 30 is assembled in a substantially continuous length from a plurality of tubing sections 130 and coiled into the carousel for storage. The sections 130 are assembled by joining their protruding flanges 132 together at their ends to form a connective joint 133 in accordance with methods known to the skilled artisan. The flanges 132 are preferably joined by removable means, such as nuts and bolts, to enable subsequent disassembly of the riser 30 at any of the joints 133, if desired.

To facilitate smooth, nonbinding engagement of the riser 30 with the belt 114*b* of the arcuate vertical conveyor 122, as well as to protect the outer surface 134 of the riser 30 during tripping operations and to add structural support to the riser 30 following installation, a plurality of spaced-apart circumferential rounded protuberances 136 are affixed to the outer surface 130 by clamping, bolting, or other means. The protuberances 136 are constructed from elastomers, plastics, foams, metals or combinations thereof. Although many protuberances 136 are shown in FIG. 8 spaced relatively close together, the present invention is not limited to any particular number of protuberances 136 or relative spacing thereof. Although such a configuration is not shown, in some cases as few as three or four broadly or closely spaced protuberances 136 along the entire length of the riser 30 may be desirable within the scope of the present invention. The protuberances 136 are preferably substantially more buoyant than the riser 30 to serve the added function of enhancing the buoyancy characteristics thereof.

The belt 114*b* may be correspondingly configured to enhance engagement thereof with the profile of the riser 30. The belt 114*b* as shown in FIG. 8 is provided with engagement enhancing means comprising rounded teeth 138*b* that fit against the sides of the protruding flanges 132 of the riser 30 while substantially clearing the protuberances 136 that typically protrude to a somewhat slightly lesser degree from the riser 30 than the flanges 132, thereby enabling the belt 114*b* to grip the flanges 132 of the riser 30 during operation of the vertical conveyor 122 without transmitting a load to the protuberances 136. The belt 114*a* of the vertical conveyor 112 is similarly configured with rounded teeth 138*a* to grip the couplings 140 of the drillstring 96. Alternatively, the belts 114*a*, 114*b* may be provided with engagement enhancing means comprising indentations (not shown) to receive the couplings 140 and flanges 132, respectively, thereby enabling the belts 114*a*, 114*b* to grip the drillstring 96 and riser 30 in a manner similar to that shown in FIG. 8.

Figure 9:
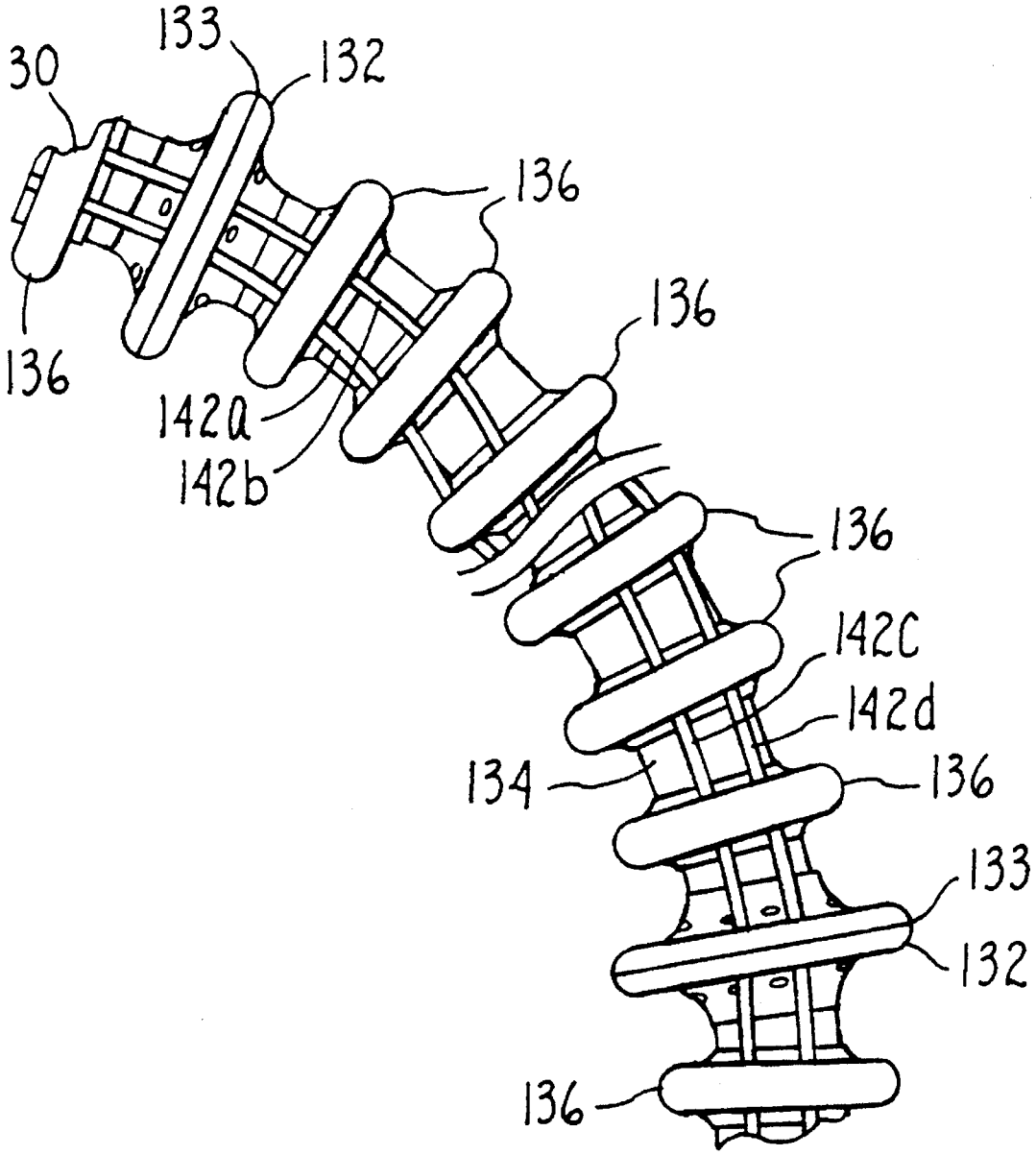
FIG. 9 is an elevational view of an embodiment of a marine drilling riser having utility in the system of the present invention.

Further details of the riser 30 are shown with reference to FIG. 9, wherein the tubular section 130 of the riser 30 is shown in a shortened view for clarity. An exemplary length of the tubular section 130 is about 20 meters, although the present invention is not limited to any specific length. A plurality of tubular utility lines 142*a*, 142*b*, 142*c*, 142*d*, such as choke and kill lines or the like, extend coaxially along the outer surface 134 of the riser 30. The utility lines 142*a*, 142*b*, 142*c*, 142*d* are threaded through the protuberances 136 disposed on the outer surface 134, enabling the protuberances 136 to maintain the position of the utility lines 142*a*, 142*b*, 142*c*, 142*d* relative to the riser 30 while protecting the lines from damage. The utility lines 142*a*, 142*b*, 142*c*, 142*d* are preferably helically disposed about the riser 30 in order to prevent damage to the utility lines 142*a*, 142*b*, 142*c*, 142*d* due to overtension or overcompression as the riser 60 is redirected by the horizontal or vertical directing means in accordance with the present invention.

Method of Operation

Operation of the system of the present invention is described below with reference to the embodiment of the system 10 shown in FIGS. 1–3. The following description of operation, however, is generally applicable to any of the above-described embodiments of the system, although it will be apparent to the skilled artisan that some modification to the generalized operating parameters of the system 10 may be required to adapt operation to the other specific embodiments of the system disclosed herein.

The system 10 has an installation mode of operation and a retrieval mode of operation. In the installation mode of operation, tripping of the jointed riser 30 is initiated by withdrawing a relatively short length of the riser 30 from the carousel 24 where it is stored in an assembled coil of substantially continuous length. The withdrawn length of the riser 30 is engaged with the horizontal sheave 26 and the drive mechanism (not shown) for the carousel 24 is activated rotating the carousel 24 in a clockwise direction and paying out the riser 30 past the horizontal and vertical sheaves 26, 28 until it reaches the deck opening 46, generally termed the moonpool. Rotation of the carousel 24 is suspended and the riser 30 is connected in a manner known to one skilled in the art to the blowout preventer and stress joint 48 which have been prepositioned in the opening 46. Rotation of the carousel 24 is then resumed while simultaneously activating the drive mechanisms (not shown) for the horizontal and vertical sheaves 26, 28, rotating them in a clockwise direction in synchronization with each other and with the carousel 24, thereby avoiding scrubbing or binding of the riser 30.

Continuous rotation of the carousel 24 and horizontal and vertical sheaves 26, 28 pays out the coiled riser 30 from the carousel 24 along a path that includes engagement with the horizontal sheave 26, redirection from the circumferential pathway of the carousel 24 in linear radially inward direction to the vertical sheave 28, engagement with the vertical sheave 28, and redirection from the linear radial direction to a linear perpendicular downward direction through the deck opening 46 into the water 14. Rotation of the carousel 24 and sheaves 26, 28 continues until the end of the riser 30 having the blowout preventer and stress joint 48 affixed thereto approaches the subsurface wellhead 16. Rotation of the carousel 24 and sheaves 26, 28 is suspended and the riser 30 is disassembled at the flanges nearest the opening 46, thereby dissociating the active portion of the riser 30 extending below the deck 20 from the system 10 and the stored portion of the riser 30 remaining in the carousel, thereby terminating tripping of the riser 30.

When tripping of the riser 30 is completed, it is desirable to clear the vertical sheave 28 from the work area at the opening 46. Accordingly, the vertical sheave 28 can be mounted on a tractor in the manner of the arcuate vertical conveyor 122 shown in FIG. 8. When the vertical sheave 28 is withdrawn from the work area by means of a tractor, unobstructed worker access is permitted to a conventional drawworks and riser handling system (not shown) provided on the deck 20. The drawworks and riser handling system enable movement of a conventional telescoping joint and tensioning joint (not shown) into place and connection to the free end of the active riser 30 at the opening 20, in a manner known to the skilled artisan. The drawworks and riser handling system also enable landing of the blowout preventer and stress joint 48 and riser 30 on the wellhead 17 to complete installation of the riser 30. The retrieval mode of operation is substantially the reverse of the above-described installation mode.

While the foregoing preferred embodiments of the invention have been described and shown, it is understood that alternatives and modifications, such as those suggested and others, may be made thereto and fall within the scope of the present invention. In particular, it is noted that the present invention has been described above with reference to different embodiments of systems encompassing numerous, but not all, combinations of the disclosed carousel configurations and horizontal and vertical directing means configurations. It is apparent that other combinations of the disclosed carousel configurations and horizontal and vertical directing means configurations than those expressly recited herein are within the purview of the skilled artisan and, accordingly, all such combinations are within the scope of the present invention.

I claim:

1. A system for conveying a tubular conduit between a deck above a surface of a body of water and a location below the surface of the body of water, said system comprising:

a deck positionable above a surface of a body of water, said deck having a perimeter and an opening through said deck;

a carousel defining a substantially continuous curved carousel pathway in substantially parallel or coplanar alignment with said deck;

a tubular conduit extending along said carousel pathway, said tubular conduit having an outer surface;

means for engaging said tubular conduit and defining a substantially horizontal curved pathway for said tubular conduit, thereby redirecting said tubular conduit in a substantially linear radial direction relative to said carousel pathway; and means for engaging said tubular conduit and defining a substantially vertical curved pathway for said tubular conduit, thereby redirecting said tubular conduit in a substantially linear perpendicular direction relative to said carousel pathway.

2. The system of claim 1 wherein said horizontal directing means is a horizontal sheave aligned substantially parallel to said carousel pathway.

3. The system of claim 1 wherein said vertical directing means is a vertical sheave aligned substantially perpendicular to said carousel pathway.

4. The system of claim 1 wherein said vertical directing means is an arcuate belt aligned substantially perpendicular to said carousel pathway.

5. The system of claim 1 wherein said vertical directing means is selectively positionable in an operable position in vertical alignment with said opening or an inoperable position out of vertical alignment with said opening.

6. The system of claim 1 wherein said tubular conduit is a first tubular conduit and said vertical directing means is a first vertical directing means, said system further comprising a second tubular conduit and a second vertical directing means for engaging said second tubular conduit and defining a substantially curved vertical pathway for said second tubular conduit, thereby redirecting said second tubular conduit from a substantially linear radial direction to a substantially linear perpendicular direction relative to said carousel pathway, further wherein said second vertical directing means is selectively positionable in said operable position in vertical alignment with said opening or said inoperable position out of vertical alignment with said opening.

7. The system of claim 6 wherein said first vertical directing means is positioned in said inoperable position when said second vertical directing means is positioned in said operable position and further wherein said second vertical directing means is positioned in said inoperable position when said first vertical directing means is positioned in said operable position.

8. The system of claim 1 wherein said tubular conduit is maintained along said carousel pathway in a substantially continuous length of assembled jointed sections.

9. The system of claim 1 wherein said carousel pathway is positioned to substantially enclose said perimeter of said deck.

10. The system of claim 1 wherein said carousel is a first carousel, said carousel pathway is a first carousel pathway, and said tubular conduit is a first tubular conduit, said system further comprising a second carousel defining a substantially continuous curved second carousel pathway in substantially parallel or coplanar alignment with said deck, and a second continuous tubular conduit extending along said second carousel pathway.

11. The system of claim 10 wherein said first carousel pathway and said second carousel pathway are substantially concentric.

12. The system of claim 10 wherein said first tubular conduit is a drilling riser and said second tubular conduit is a drillstring.

13. The system of claim 1 wherein said tubular conduit is a drilling riser.

14. The system of claim 1 further comprising a semisubmersible supporting said deck in the body of water.

15. The system of claim 1 further comprising a plurality of protuberances mounted on said outer surface of said tubular conduit.

16. The system of claim 4 further comprising means positioned on said arcuate belt for enhancing engagement of said tubular conduit as said arcuate belt redirects said tubular conduit.

17. The system of claim 1 further comprising a tubular utility line extending coaxially adjacent to said outer surface of said tubular conduit in a helical configuration.

18. The system of claim 17 further comprising a tubular utility line extending coaxially adjacent to said outer surface of said tubular conduit, wherein said protuberances engage said utility line to maintain said utility line in position relative to said tubular conduit.

19. A system for drilling a subsea well comprising:

a deck positionable above a surface of a body of water, said deck having a perimeter and an opening through said deck;

a carousel defining a substantially continuous curved carousel pathway in substantially parallel or coplanar alignment with said deck;

a tubular drilling riser extending along said carousel pathway; and means for engaging said riser and defining a substantially vertical curved pathway for said riser, thereby redirecting said riser in a substantially linear perpendicular downward direction relative to said carousel pathway.

20. The system of claim 19 further comprising means for engaging said riser and defining a substantially horizontal curved pathway for said riser, thereby redirecting said riser in a substantially linear radially inward direction relative to said carousel pathway.

21. The system of claim 20 wherein said horizontal directing means is a horizontal sheave aligned substantially parallel to said carousel pathway.

22. The system of claim 19 wherein said vertical directing means is a vertical sheave aligned substantially perpendicular to said carousel pathway.

23. The system of claim 19 wherein said vertical directing means is an arcuate belt aligned substantially perpendicular to said carousel pathway.

24. The system of claim 19 wherein said vertical directing means is a first vertical directing means selectively positionable in an operable position in vertical alignment with said opening or an inoperable position out of vertical alignment with said opening, said system further comprising a substantially continuous drillstring and a second vertical directing means for engaging said drillstring and defining a substantially vertical curved pathway for said drillstring, thereby redirecting said drillstring in a substantially linear perpendicular downward direction relative to said carousel pathway, further wherein said second vertical directing means is selectively positionable in said operable position in vertical alignment with said opening or said inoperable position out of vertical alignment with said opening.

25. The system of claim 19 wherein said carousel pathway is positioned substantially around said perimeter of said deck.

26. The system of claim 19 wherein said carousel is a first carousel and said carousel pathway is a first carousel pathway, said system further comprising a second carousel defining a substantially continuous curved second carousel pathway in substantially parallel or coplanar alignment with said deck, and a substantially continuous drillstring extending along said second carousel pathway.

27. The system of claim 26 wherein said first carousel pathway and said second carousel pathway are substantially concentric.

28. A system for drilling a subsea well comprising:

a deck positionable above a surface of a body of water, said deck having an opening therethrough;

a semisubmersible supporting said deck in the body of water, said vessel having a perimeter;

a carousel defining a substantially continuous curved carousel pathway in substantially parallel alignment with said deck;

a tubular drilling riser extending along said carousel pathway; and means for engaging said riser and defining a substantially vertical curved pathway for said riser, thereby redirecting said riser in a substantially linear perpendicular downward direction relative to said carousel pathway.

29. The system of claim 28 further comprising means for engaging said riser and directing said riser along a substantially curved horizontal pathway, thereby redirecting said riser in a substantially linear radially inward direction relative to said carousel pathway.

30. The system of claim 28 wherein said carousel pathway is positioned substantially around said perimeter of said vessel.

31. A method for tripping a tubular conduit from a deck above a surface of a body of water to a location below the surface of the body of water, said method comprising:

positioning a deck above a surface of a body of water, said deck having a perimeter and an opening through said deck;

coiling a tubular conduit having a plurality of connected disconnectable joints formed therein along a substantially continuous curved pathway in substantially parallel or coplanar alignment with said deck;

conveying said tubular conduit from said continuous curved pathway in a substantially linear inward radial direction relative to said continuous curved pathway; and conveying said tubular conduit from said linear inward radial direction in a substantially linear downward perpendicular direction relative to said continuous curved pathway.

32. The method of claim 31 wherein said tubular conduit is conveyed in said substantially linear inward radial direction by redirecting said tubular conduit from said continuous curved pathway along a substantially horizontal inwardly curved pathway.

33. The method of claim 31 wherein said tubular conduit is conveyed in said substantially linear downward perpendicular direction by redirecting said tubular conduit from said linear inward radial direction along a substantially vertical downwardly curved pathway.

34. The method of claim 31 further comprising conveying said tubular conduit through said opening into said body of water.

35. The method of claim 34 further comprising disconnecting one of said plurality of disconnectable joints proximal to said opening when said tubular conduit is conveyed to a predetermined location in said body of water, thereby separating said tubular conduit into a first portion coiled along said continuous curved pathway and a second portion extending from said opening into said continuous body of water.

36. A method for tripping a tubular conduit from a location below a surface of a body of water to a deck above the surface of the body of water, said method comprising:

positioning a deck above a surface of a body of water, said deck having a perimeter and an opening through said deck;

conveying a tubular conduit having a plurality of connected disconnectable joints formed therein from said body of water through said opening in a substantially linear upward perpendicular direction relative to said deck;

conveying said tubular conduit from said substantially linear upward perpendicular direction in a substantially linear outward radial direction relative to said deck; and coiling said tubular conduit from said substantially linear outward radial direction along a substantially continuous curved pathway in substantially parallel or coplanar alignment with said deck.

37. The method of claim 36 wherein said tubular conduit is conveyed in said substantially linear outward radial direction by redirecting said tubular conduit from said substantially linear upward perpendicular direction along a substantially vertical upwardly curved pathway.

38. The method of claim 36 wherein said tubular conduit is coiled in said substantially continuous curved pathway by redirecting said tubular conduit from said linear outward radial direction along a substantially horizontal downwardly curved pathway.

* * * * *